United States Patent [19]

Faust et al.

[11] 3,991,703

[45] Nov. 16, 1976

[54] SIREN FOR ALARM AND METHOD OF MAKING THE SAME

[75] Inventors: James H. Faust, Cicero; Walter M. Busse, Chicago, both of Ill.

[73] Assignee: A.B.C. Auto Alarms, Inc., Chicago, Ill.

[22] Filed: Sept. 8, 1975

[21] Appl. No.: 611,501

[52] U.S. Cl. ..... 116/147; 29/156.8 R; 113/116 D

[51] Int. Cl.[2] ..... G10K 7/02

[58] Field of Search ..... 116/147; 113/116 D; 29/156.8 CF, 156.8 R, 159 R; 46/179

[56] References Cited

UNITED STATES PATENTS

| | | | |
|---|---|---|---|
| 2,015,387 | 9/1935 | Seiss | 116/147 |
| 2,493,053 | 1/1950 | Zatyko | 113/116 D |
| 2,756,416 | 7/1956 | Griparis | 116/147 |
| 3,199,179 | 8/1965 | Laing | 29/156.8 CF |

FOREIGN PATENTS OR APPLICATIONS

| | | | |
|---|---|---|---|
| 425,911 | 4/1911 | France | 116/147 |

*Primary Examiner*—S. Clement Swisher
*Assistant Examiner*—Denis E. Corr
*Attorney, Agent, or Firm*—Silverman & Cass, Ltd.

[57] ABSTRACT

A siren for an alarm adapted to be driven by a fractional horsepower motor comprising a cup-shaped rotor cooperating with a stator having rectangular perforations in a cylindrical flange, the cup-shaped rotor and the stator being both formed as stampings, the rotor having an integral base plate staked to a hub, the base plate having a plurality of shear-formed upstanding vanes of identical irregular polygonal configuration circumferentially arranged around the center of the base plate, the cylindrical wall of the rotor having rectangular perforations equal in number to the number of vanes and each vane having a perforation adjacent thereto at the identical respective location.

The method of making a siren having a stator and a rotor and in which the rotor is formed by the steps of drawing a cup from sheet metal and providing a central hole in the base plate of the cup, punching rectangular perforations in the cup flange circumferentially therearound and equally spaced, shear-forming vanes in the base plate of irregular polygonal configuration to leave congruent openings in the base plate aligned with the perforation in the cup flange and with the vanes arranged normal to the base plate, and staking a hub to the base plate, the siren being assembled by mounting the rotor inside of the stator and closely spaced therefrom.

4 Claims, 6 Drawing Figures

SIREN FOR ALARM AND METHOD OF MAKING THE SAME

BACKGROUND AND FIELD OF THE INVENTION

The field of the invention is alarm sirens for use primarily in domestic installations where the siren is to be driven by a fractional horsepower motor. The most important example of this is in vehicle alarms which operate of 12 volt systems.

Alarms of this type are known generally and comprise relatively simple structures. Usually there is a framework or bracket which mounts the motor and may have electrical terminals, switches and the like also mounted thereon which are of no concern to this invention. The shaft of the motor protrudes through a support plate, and a casing or housing which is generally cup-shaped is mounted on the support plate coaxially with the shaft. Means are normally provided for accurately centering the casing or housing which will be called a stator hereinafter. The outer flange or the stator has a plurality of perforations to cooperate with similar perforations provided in a rotor that is mounted on the shaft. The rotor is of a configuration closely following that of the stator -13 hence cup-shaped and in addition to the perforations on its cylindrical outer flange, it has vanes to promote movement of air in creating the turbulence that produces the high pitched sound desired.

The invention is primarily concerned with small sirens, say of a diameter of about 3 inches or so, which can be driven at speeds of 10 to 13,000 r.p.m. and more for producing very high-pitched tones. It is not so limited, however, although as will be seen, the major advantages come from its use in these small sirens.

Automobile alarms, for example, are intended to be installed quickly and economically and readily moved from vehicle to vehicle by the owner. The expense involved becomes an important factor in the business of making and installing such alarms, but it is axiomatic that function is the most important criterion. It becomes a compromise between economy and performance which will determine the quality of a given installation.

The low-priced sirens which are available today, utilize generally two types of rotors, the rotor being the key to the performance of the siren. So far as known, these types are die-cast rotors and fabricated rotors.

The die-cast rotors are subject to flaws during casting, are necessarily formed with thick parts for strength and are expensive. The difficulties of casting absolutely uniform and symmetrical rotors means that these rotors are often not perfectly balanced and will not rotate as fast as they could if they were perfectly balanced. Unbalanced rotors use more power than balanced rotors.

The fabricated rotors are made by assembling at least two parts which have been separately formed. These is a cup-shaped part which has a base plate and a plurality of rectangular perforations around the periphery of the flange, and there is a vane part which has a central support and arms with vanes punched and formed thereon. These two parts are spot-welded or staked together. There is a problem of achieving perfect balance here.

The invention uses a rotor which is a unitary article formed from a single piece of sheet metal and is perfectly balanced and much more economical to manufacture than either of the other two types of rotor. It is lighter in weight than either, it is capable of higher speeds and will rotate faster for the same motor and produce a louder sound. It eliminates considerable assembly time.

SUMMARY OF THE INVENTION

A siren in which the rotor is formed as an integral member of sheet metal having a generally cup-shaped configuration. These is a circular disc forming the base plate from which upstanding vanes are shear-formed, the vanes being ploygonal in configuration but preferably irregular in that the openings from which the vanes are punched are arranged to give the maximum size of vane while maintaining sufficient material between such openings for strength. The cylindrical flange of the rotor has generally rectangular perforations circumferentially spaced and aligned with the openings from which the vanes are shear-formed.

The stator is generally cylindrical and is mounted on the suport plate which holds the motor for driving the rotor. The rotor has a hub staked thereto and is accurately coaxial with the stator. The stator has a cylindrical flange which is also perforated to cooperate with the perforations of the rotor to produce the desired sound when the rotor is rotated at high speed. The radial spacing between stator and rotor is very small and maintained by lugs formed in the support plate and to which the stator is secured. The axially outward end of the stator is provided with an annular baffle and its axially inward end is open to fit outside of the lugs when flatly engaged against the support plate.

The rotor is formed from sheet metal in a plurality of steps which comprise first blanking and drawing a cup formation having a round base plate and an integral cylindrical flange, forming a central opening some time during the first step, then punching the rectangular openings in the flange, then shear-forming and bending up the vanes and finally staking a hub to the central opening.

DESCRIPTION OF THE PREFERRED EMBODIMENT

As indicated above, the siren of the invention is economical and appears to perform better than the commercially available sirens which utilized either the die-cast rotor or the fabricated rotor which have been described as prior art. The key to this performance comprises the rotor, the invention being believed to reside as to novelty principally in the construction of this rotor and the method of making the same.

Figure 1:
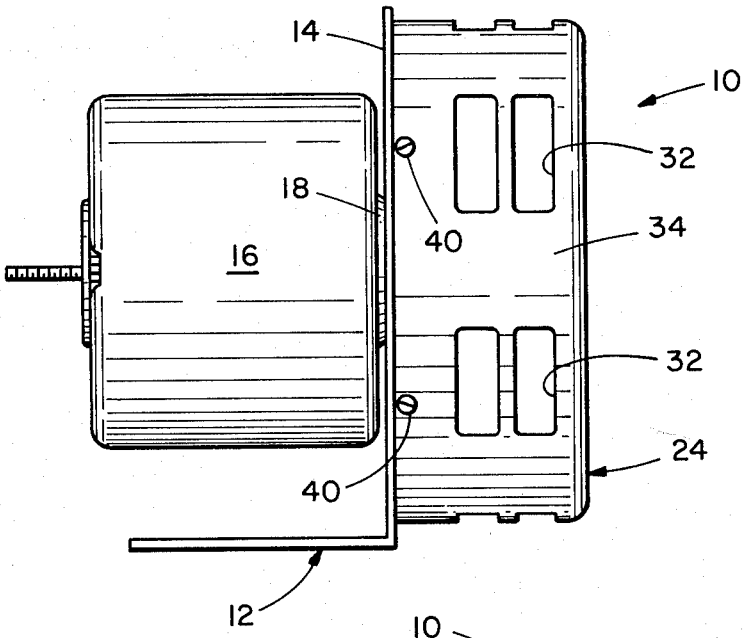
FIG. 1 is a side elevational view of a siren constructed in accordance with the invention.
Figure 2:
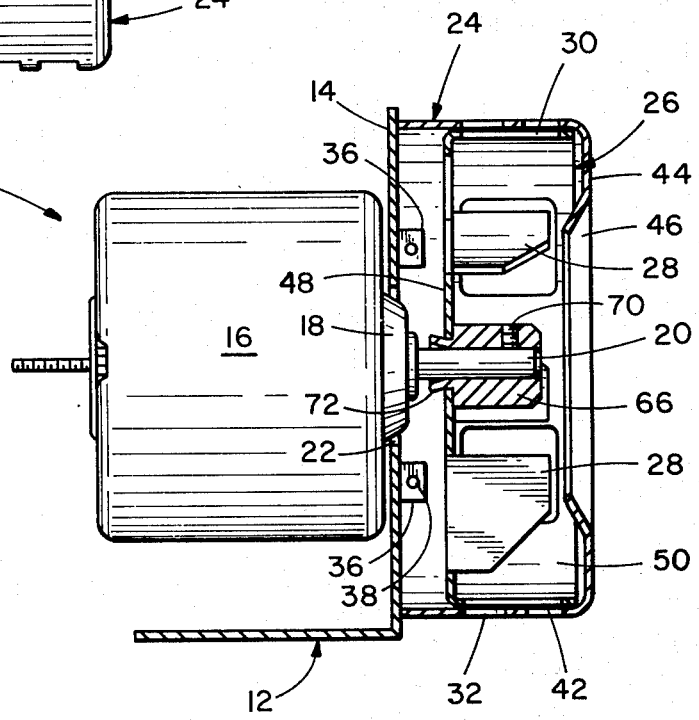
FIG. 2 is a vertical sectional view taken through the same.

The siren of the invention is designated generally by the reference character 10 and is shown generally only in FIGS. 1 and 2, the remainder of the figures being devoted to the construction of the rotor per se. There is a support bracket or frame 12 which may be a part of another structure or a structural member of a vehicle but, in view of the semi-portable nature of the siren 10, it is likely that there will be a support bracket of this type with each siren that is made and sold. The support bracket 12 has an upstanding support plate 14 to the left face of which there is secured a fractional horsepower electric motor 16 by any suitable means (not shown). Screws may pass through the housing of the motor 16, for example, and into the plate 14.

The motor boss 18 and coaxial shaft 20 pass through a suitable opening 22 in the plate 14 and protrude from the right hand face of the plate 14. The stator 24 is secured to the plate 14 over the rotor 26, the rotor 26 being mounted to the shaft 20 and the stator 24 being accurately positioned coaxially with respect to the rotor 26.

The general operation of this siren 10 is no different from any other known siren of this type. The rotation of the rotor 26 forces the vanes 28 to churn the air in the siren and the air driven outwardly from the interior passes through the rotor slots 30 and is chopped by the stator slots 32, the frequency of the resulting sound being determined by the number of slots and the rotational speed of the rotor 26.

The stator 24 has a cylindrical configuration and provides a cylindrical flange 34 in which the slots 32 are punched during manufacture. The left hand end of the stator 24 is open and engaged over the outside of a series of lugs or ears 36 which are struck from and bent at right angles to the support plate 14. These ears 36 are arranged in a circle and carefully dimensioned in such circle to precisely define the location of the inner surface of the flange 24. The ears are drilled and tapped as at 38 to receive mounting screws 40 passing through suitable holes in the flange 34 from the exterior thereof and engaging the threaded holes of the ears. The locaton of the flange 24 is chosen to define a very small gap — of the order of 1/32 inch between the rotor 26 and stator 24 when the siren 10 is assembled. The gap is designated 42 and is shown in FIG. 2.

The axially outer end of the stator 24 is also open but has a reduced center due to an annular baffle 44 that is integral with the flange 34 and extends radially inward and then funnels into the center of the stator as shown at 46. This funnel 46 leads air into the siren and the axial end of the funnel clears the vanes 28 of the rotor by a fraction of an inch.

Figure 3:
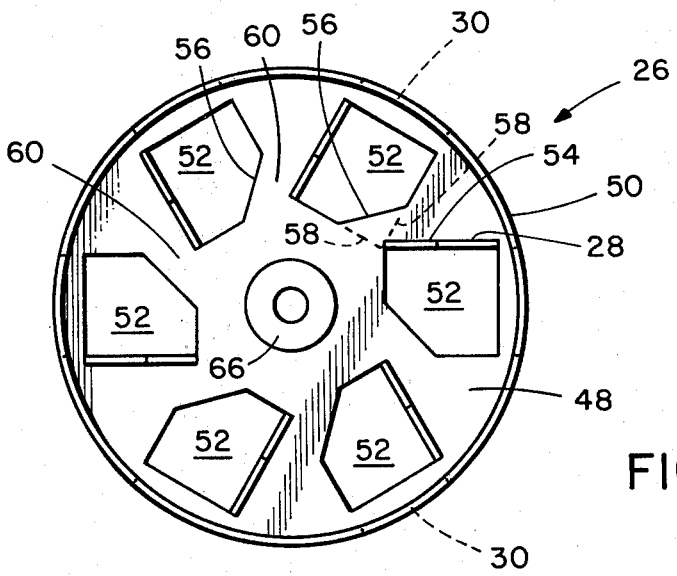
FIG. 3 is a top plan view of the rotor of the siren of the invention.
Figure 4:
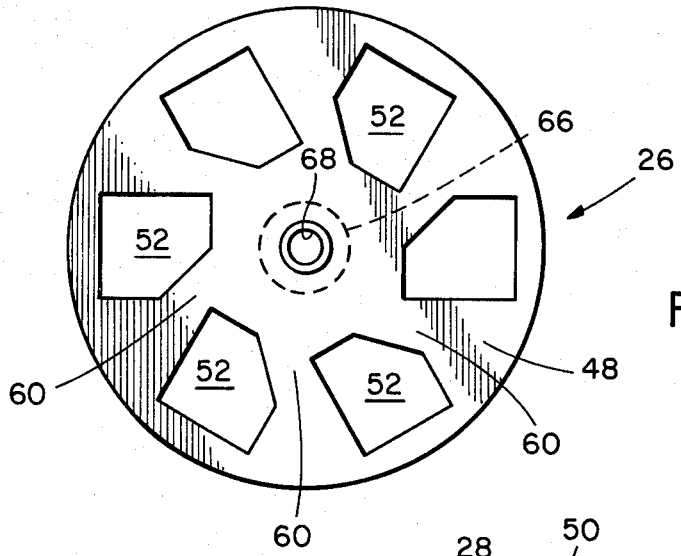
FIG. 4 is a bottom plan view of the same.
Figure 5:
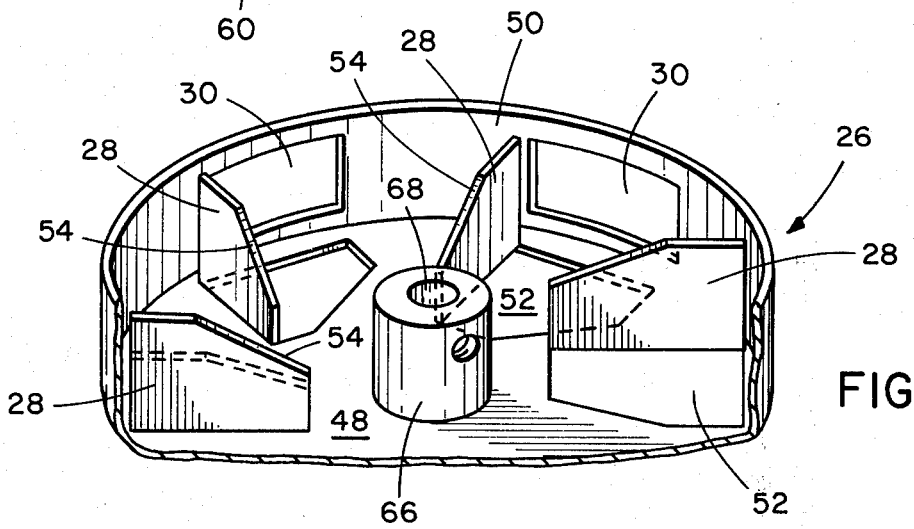
FIG. 5 is a fragmentary perspective view of the rotor.

The rotor 26 is made as will be described, but in its completed form is best shown in FIGS. 3, 4 and 5. There is a planar base plate 48 which has six vanes 28 shear formed therefrom and bent at right angles thereto. These is a cylindrical flange 50 integral with and surrounding the base plate 48 to provide a cup-like configuration. The vanes 28 are bent in a direction to bring them into interior of the cup-shaped configuration. The planes of the vanes 28 are spaced radially outward of the axis of the rotor 26 for better air efficiency. Additionally, in view of the openings which will be formed in the base plate 48 when the vanes 28 are struck, this gives a large area vane without sacrificing strength. This can be seen from the geometry of the structure.

Each vane 28 is shear-formed from the base plate 48 thereby leaving an opening 52 of substantially the identical configuration in the base plate. The shape of the vanes 28 is polygonal, and, but for the angled edge 54 thereof would be practically rectangular. This angled edge 54 causes a similar angled edge 56 to be formed in each opening 52. In FIG. 3 there is shown in broken lines 58 the extension of the adjacent edges of an opening 52 past the edge 56. This shows that instead of making the vanes exactly rectangular with a resulting rectangular hole in the base plate 48, the provision of the angled edge 56 results in a substantial neck of material 60 between openings 52. This gives strength to the rotor 26, enable it to be self-supporting and not liable to be distorted notwithstanding high speed rotation. The angled edges 54 of the vanes have no detectable effect upon the efficiency of the siren.

The cylindrical flange 50 of the rotor 26 is provided with rectangular (albeit curved) slots 30 aligned radially with the openings 52 and so located axially that when the siren is assembled, the slots 30 will align with the slots 32. The circumferential spacing of the vanes 28, the openings 52 and the slots 30 is the same throughout. The circumferential spacing of the slots 32 may be the same or different from the spacing of the slots 30 of the rotor 26, but need not be. The spacing is equidistant from slot to slot on the circumference of the rotor, however.

The rotor has a central hub 66 staked or otherwise secured at the center thereof having a passageway 68 to accommodate the shaft 20 in a close fit. A setscrew 70 holds the hub 66 and hence the rotor 26 to the shaft 20. The staked protrusion of the hub through a suitable central opening in the base plate 48 is shown at 72.

Figure 6:
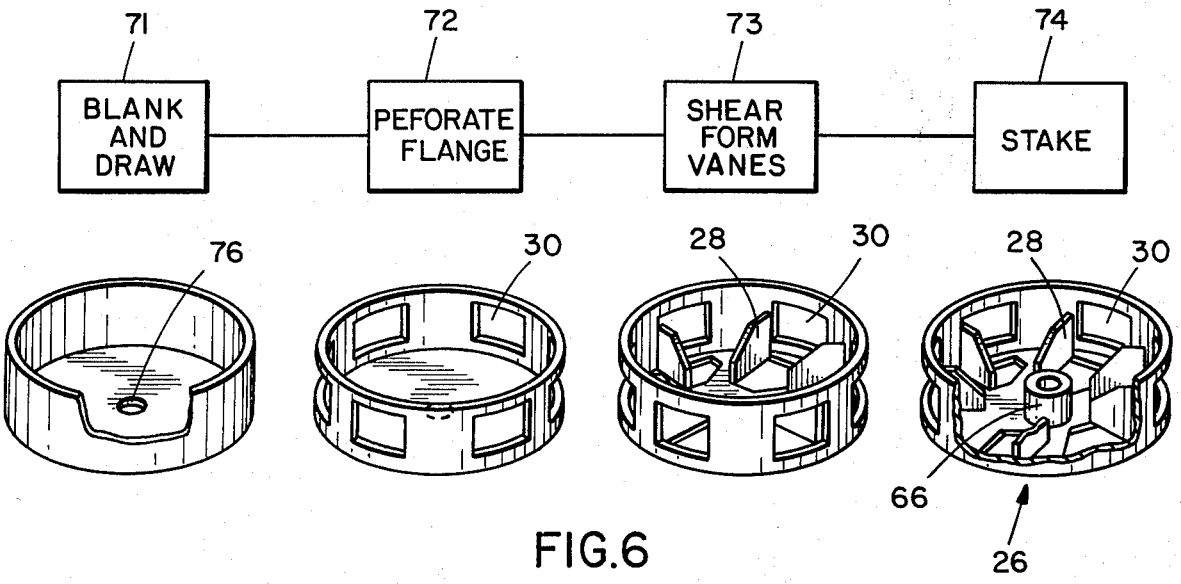
FIG. 6 is a diagrammatic view showing in a series of blocks and perspective views the various steps of the method of making the rotor.

The method of making the rotor is simple but effective. It nonetheles is believed not obvious because of the seeming three-dimensional complexity of the resulting structure. Thus, a blank of sheet steel, for example, is drawn and pierced. The first block 71 of FIG. 6 is marked "Blank & Draw." This is the step in which the cup is formed. It could be done by blanking from a continuous strip of metal in a progressive die followed by drawing or it could be done by blanking the discs in an earlier operation. The center hole 76 can be pierced at any time along the process.

The second step of the process is illustrated in FIG. 6 in block 72 and the sketch below. This step is designated "Perforate Flange." After the cup has been formed, the cylindrical flange is perforated with rectangular openings in any suitable punching machine. This can be done by laterally moving punches in a suitable fixture which supports the cup during the process. The perforating step is not practical before the drawing of the cup because of the likelihood of distortion of the perforations, although the function of the perforations will not be impaired if they are somewhat distorted. Accurate placement and formation assures balance.

The next step of the process consists in shear-forming the vanes and this is represented by the block 73 and the sketch below it. In this step suitable punches shear the three free edges of the vanes 28 from the base plate 48 at the proper locations and raise the vanes to their vertical disposition, either simultaneously or by other means in the die.

The last step in the making of the rotor is to place the hub or bushing 66 into the hole 76 and stake it. This can be done in a separate operation, if desired.

Assembly of the siren 10 is effected in a conventional manner. The shaft 20 will usually have indexing means such as a shoulder or flat or notch to axially position the hub 66 at a proper locatin when engaged thereon. The set screw 70 is screwed tightly home thereafter and the stator 24 engaged over the rotor 26 and properly positioned with relation to the lugs 36. The holes 38 and those in the cylindrical flange 34 are twisted into alignment and the screws 40 tightened.

The perforations 32 are shown as pairs but can be of any geometric form having a combined area as to any group which is approximately the area of the respective perforations 62.

The siren 10 has a minimum of parts. Besides the motor 16 and its support plate 14 there are only two parts, one of which is pre-assembled from two pieces. These two parts comprise the stator 24 which is readily stamped from sheet metal and the rotor 26 which is also formed as an integral stamping. The hub 66 is the third piece but is staKed to the base plate 48 of the rotor 26 before the assembly of the siren. The only operation which is not capable of being effected in automatic machinery operating in a progressive manner is the manufacture of the hub and its staking to the rotor body. Even then, the hub will probably be a screw-machine part and will be made with great precision. The point of importance is that since there are no major assembly operations and the stamping operations are inherently quite accurate, the rotor is capable of being made in a form which is highly balanced as it comes out of production. This given many of the advantages of the invention. Light weight is an added factor.

Modifications in the details and configuration of the various parts of the invention are capable of being made without departing from the spirit of the invention as defined in scope by the appended claims.

What it is desired to secure by Letters Patent of the United States is:

1. In a radial flow siren which includes a motor, means for mounting the motor with a shaft protruding, a perforated cup-shaped stator coaxial with the shaft and having the perforations around the circumference thereof, the invention herein which comprises a perforated and vaned rotor mounted on the shaft for rotation relative to the stator and arranged to draw air into the siren axially and discharge it through the perforations radially, and said rotor A. being formed of an integral sheet metal stamping, B. having a circular base plate provided at the center thereof with means for mounting the rotor to the shaft, C. having a plurality of shear-formed upstanding vanes of indentical polygonal configuration and having a right angle corner, said vanes being connected to said base plate equally spaced circumferentially about the center of the base plate and perpendicular thereto, D. each vane being formed by material removed and bent up from the base plate and thereby leaving an opening in the base plate to only one edge of which the vane is connected by a bend, the opening being of substantially the same configuration as the vane, E. a cylindrical flange around the base plate and the vanes being arranged to have an edge of each which is adjacent said corner approaching closely to the inside surface of the flange and being at a substantial angle thereto, and F. the cylindrical flange having generally rectangular perforations each adjacent a respective vane.

2. The structure as claimed in claim 1 in which the vanes lie in planes which extend generally radially of the flange.

3. The structure as claimed in claim 2 in which the planes are spaced from the center of the base plate.

4. In a siren which includes a motor, means for mounting the motor with a shaft protruding, a perforated cup-shaped stator coaxial with the shaft, and the invention herein which comprises a perforated and vaned rotor mounted on the shaft for rotation relative to the stator, and said rotor A. being formed of an integral sheet metal stamping, B. having a circular base plate provided at the center thereof with means for mounting the rotor to the shaft, C. having a plurality of shear-formed upstanding vanes of identical polygonal configuration connected to said base plate and equally spaced circumferentially about the center of the base plate, D. each vane being formed by material removed and bent up from the base plate and thereby leaving an opening in the base plate to one edge of which the vane is connected by a bend, the opening being of substantially the same configuration as the vane, E. a cylindrical flange around the base plate and the vanes being arranged to have an edge of each approaching closely to the inside surface of the flange and being at a substantial angle thereto, F. the cylindrical flange having generally rectangular perforations each adjacent a respective vane and G. said vanes each being configured like a rectangle with a corner removed, the resulting angled edge being located on the radially innermost part of each vane such that the openings in the base plate from which the vanes are cut have greater webs of material between them close to the center of the base plate than they would have if the openings were substantially rectangular.

* * * * *